US005484127A

United States Patent [19]

Mower et al.

[11] Patent Number: 5,484,127

[45] Date of Patent: Jan. 16, 1996

[54] ANGLED SUPPORT BRACE

[75] Inventors: Barry D. Mower; Tony L. England, both of Layton, Utah

[73] Assignee: Lifetime Products, Inc., Clearfield, Utah

[21] Appl. No.: 275,587

[22] Filed: Jul. 15, 1994

[51] Int. Cl.[6] ..... A63B 63/00

[52] U.S. Cl. ..... 248/284.1; 248/544; 248/281.11

[58] Field of Search ..... 248/351, 544, 248/281.1, 284.1, 276, 300, 291; 273/1.5 R, 1.5 A; 211/194

[56] References Cited

U.S. PATENT DOCUMENTS

| | | | |
|---|---|---|---|
| 627,516 | 6/1899 | Morgan . | |
| 806,790 | 12/1905 | Foersterling . | |
| 964,394 | 7/1910 | Coddington . | |
| 1,924,811 | 8/1933 | Schulz . | |
| 1,926,674 | 9/1933 | Gross . | |
| 2,227,310 | 12/1940 | Hoppes et al. . | |
| 2,313,188 | 3/1943 | Woodburn . | |
| 2,831,689 | 4/1958 | Marsh . | |
| 2,869,731 | 1/1959 | Axelrod | 211/194 |
| 2,898,065 | 8/1959 | Ackley . | |
| 3,094,303 | 6/1963 | Belger . | |
| 3,427,025 | 2/1969 | Procter . | |
| 3,469,870 | 9/1969 | Barkus . | |
| 3,586,324 | 6/1971 | Bearson . | |
| 3,765,676 | 10/1973 | Bearson et al. . | |
| 3,802,702 | 4/1974 | Pulley . | |
| 3,900,194 | 8/1975 | Ward et al. . | |
| 4,114,764 | 9/1978 | Rich . | |
| 4,151,989 | 5/1979 | Dittrich . | |
| 4,247,011 | 1/1981 | Walter | 211/194 |
| 4,330,101 | 5/1982 | Anderson . | |
| 4,395,040 | 7/1983 | White . | |
| 4,433,839 | 2/1984 | Simonseth . | |
| 4,465,277 | 8/1984 | Dittrich . | |
| 4,759,451 | 7/1988 | Apps | 211/194 X |

(List continued on next page.)

FOREIGN PATENT DOCUMENTS

| | | |
|---|---|---|
| 755442 | 11/1933 | France . |
| 326491 | 4/1935 | Italy . |
| 908055 | 10/1962 | United Kingdom . |
| 1152846 | 5/1969 | United Kingdom . |

OTHER PUBLICATIONS

Lifetime Products, Inc., "Institutional Basketball Equipment," pp. 1, 3, 4, 6.

Huffy Sports, "Basketball's Hottest Products This Year," p. 21.

Huffy Sports, "Our All–Star Lineup," pp. (insert between pp. 4 and 5), 27.

Harvard, "Sporting Goods Catalog," 1988, p. 8.

Porter, "Celebrating 100 Years of Basketball," pp. 2, 3, 6, 18, 22.

*Primary Examiner*—Karen J. Chotkowski

*Attorney, Agent, or Firm*—Madson & Metcalf

[57] ABSTRACT

A support brace for the adjustable support of a basketball goal system having a deformable parallelogrammatic structure is disclosed. The support brace is pivotally connected to the parallelogrammatic structure so that the brace can pivot in a vertical plane in response to the application and release of a force applying implement. The support brace comprises a trough shaped member, integrally formed of a single unit of material, with an elongated base and a pair of sides angularly extending from the base. The support brace is stackable such that multiple support braces are capable of being stacked one on top of another, with the base of one brace fitting within the trough of an adjacent brace. The trough shaped member has a locking mechanism for securing the parallelogrammatic structure in one of a plurality of positions and a receiving member for receiving a tip of the force-applying implement and restraining the tip from inadvertent slippage from the support brace. The receiving member is positioned such that a force may be applied to the support brace to pivot the support brace in a vertical plane between an engaged position and a disengaged position.

15 Claims, 3 Drawing Sheets

U.S. PATENT DOCUMENTS 4,759,545 7/1988 Grable .
4,781,375 11/1988 Nye .
4,784,432 11/1988 Brown .
4,798,381 1/1989 Dadbeh .
4,805,904 2/1989 Nye .
4,881,734 11/1989 Nye .
5,014,983 5/1991 Saunders .
5,158,281 10/1992 Williams .
5,191,852 3/1993 Rupp .
5,292,118 3/1994 Allen et al. ..... 248/284 X
5,324,027 6/1994 Nye ..... 248/281.1 X

ANGLED SUPPORT BRACE

FIELD OF THE INVENTION

The present invention relates to support braces for structures having a deformable parallelogrammatic structure. More specifically, the present invention relates to a support brace for an adjustable basketball goal system having a deformable parallelogrammatic structure.

BACKGROUND OF THE INVENTION

In the popular sport of basketball, there has been an increasing demand over the past several years for basketball goals which are adjustable to several different heights. To meet this increasing demand, a variety of designs have been attempted to provide such an adjustable basketball goal. One of the more popular designs employs a deformable parallelogrammatic structure, wherein pivotally mounted parallel bars connect the basketball backboard to a rigid mounting device such as a pole. The parallel bars combine with the basketball backboard and the rigid mounting device to form a parallelogram. Because the bars are pivotally mounted, the basketball backboard can be moved to several different heights while remaining vertically disposed. When the basketball goal is at its desired height, a locking means is used to "lock" the parallelogram in place.

U.S. Pat. No. 4,805,904 discloses an example of a basketball goal system utilizing such a deformable parallelogrammatic structure (hereinafter the "'904 device"). In the '904 device, an adjustable support brace is employed to lock the parallelogram into one of a plurality of configurations. The support brace, which comprises two parallel arms, is pivotally mounted at one of its ends to the vertex of the parallelogram nearest the basketball rim. At the other end of the support brace, each parallel arm contains a longitudinal slot with a plurality of notches. Each of these notches is capable of slidably engaging a rigid post, or to bolt, which is firmly mounted to the upper support member of the parallelogrammatic structure. When the post or bolt is engaged within one of the notches, the parallelogrammatic structure is "locked" into place, thereby preventing further deformation of the parallelogram.

A downward force (such as gravity) applied to the basketball goal secures the post within the notch and prevents movement of the support brace or the parallelogram. Release of the post from the notch to allow a change in the configuration of the parallelogram is permitted when a sufficient upward force is applied at the basketball goal. When an upward force is applied to the support brace at a point near its pivoting end, the support brace pivots about its axis at the vertex of the parallelogrammatic structure such that the post becomes disengaged from the notch and disposed within the longitudinal slot. At this point, the shape of the parallelogrammatic structure may be altered to adjust the height of the basketball goal.

The support brace of the '904 device is capable of adequately securing the deformable parallelogrammatic structure of the basketball goal system in a variety of positions, but is not without certain disadvantages. One significant disadvantage of the support brace for the '904 device is the number of components comprising the brace. The support brace comprises at least three separate component pieces and spacers are needed to maintain the proper parallel positioning of the sides of the support brace. As an initial matter, the support brace is costly to manufacture. It would be a cost-saving advantage if the support brace could be made from a single component.

An additional disadvantage, also related to the number of component pieces comprising the brace, is the problem of storage of the individual component pieces before and during manufacture. Each of the separate pieces, once manufactured, must be stored separately, yet must still be in close proximity to one another as they will eventually comprise a single unit. The storage of three or more separate pieces creates problems of both time and space. It would be an advantage then, in terms of storage, if the support brace was comprised of a single component. It would be a further advantage if this single component was easily stackable.

A further disadvantage of the support brace for the '904 device is the degree of difficulty in assembly. Most adjustable basketball goal systems are sold in an unassembled form, thus requiring at-home assembly by the purchaser. Because each of the two parallel arms has both an inner facing surface as well as an outer facing surface, and a top as well as a bottom, it is easy, and not uncommon, for a purchaser to initially install the support brace arms in either a backwards or upside down manner. As anyone who has ever attempted to assemble a mechanical device with multiple parts knows, this is a very frustrating experience. It can be appreciated, then, that it would be an improvement in the art if the support brace was comprised of a single component, with a clearly defined top and bottom, such that a purchaser would be less likely to install the support brace backwards or upside down.

Still another disadvantage of the support brace for the '904 device is that the brace will either not function, or will function only with great difficulty, if the rigid post or bolt which engages a notch becomes bent. Unfortunately, any rigid post or bolt which is subjected to repeated stress may become bent. The support brace for the '904 device, with parallel arms having corresponding notches designed to engage a straight post, is not well suited to engage a bent post. Thus, if the post becomes bent, the support brace ceases to function effectively and the post must be replaced. It would be an advancement in the art, then, if the support brace was designed to function effectively even though the post or bolt becomes modestly bent, as may happen over time.

It will be appreciated, therefore, that what is needed in the art is a support brace for the adjustable support of a basketball goal system which is comprised of a single component, such that the manufacture and storage of the brace is made easier, assembly of the goal system by the purchaser is simplified, and the brace more readily accommodates a post to or bolt which has become modestly bent through repeated use.

BRIEF SUMMARY AND OBJECTS OF THE INVENTION

The novel support brace disclosed operates as an adjustable support for a basketball goal system where the goal system has a deformable parallelogrammatic structure. The support brace is pivotally connected at one of its ends to the parallelogrammatic structure so that the brace can pivot in a vertical plane when an upward force is applied to the support brace. The upward force is preferably applied by a rod shaped implement, such as a broom handle, or a similar device.

The support brace of the present invention comprises a trough shaped member with an elongated base and a pair of sides extending from the base. The two sides of the brace extend from the base in an angular fashion, diverging away from one another such that the distance between the sides is greater near the unattached, free edge of each side than it is nearer the base. The support brace thus comprises a somewhat "V"-shaped trough with a flattened base.

The support brace of the present invention further comprises a locking means for securing a basketball goal system with a deformable parallelogrammatic structure in one of a plurality of positions. In the presently preferred embodiment, the locking means comprises a slot which extends substantially longitudinally along each of the two sides of the brace, wherein each slot provides a series of notches capable of engaging a post connected to the deformable parallelogrammatic structure. Each slot corresponds with the slot of the other side. The deformable parallelogrammatic structure becomes locked into one configuration when the post connected to the parallelogrammatic structure is engaged in one of the notches of the slot.

In conjunction with the locking means, the novel support brace further provides a guiding means for guiding the support brace from a first position to a second position of a different height. In the presently preferred embodiment, the guiding means consists of a plurality of sloped, guiding teeth configured along each slot such that for each notch there corresponds one guiding tooth.

Additionally, the support brace of the present invention comprises a receiving member for receiving a tip of a force-applying implement (such as a broom handle) and restraining the tip from inadvertent slippage from the support brace. In the presently preferred embodiment, the receiving member comprises a "T"-shaped base member with an elongated stem and two side ears, and two sides which are continuous with the angled sides of the support brace. Each side of the receiving member contains a notch capable of engaging one of the side ears of the base member. The two sides of the receiving member extend past the longitudinal plane formed by the "T"-shaped base member such that a pocket is formed for receiving a tip of the force-applying implement and restraining the tip from inadvertent slippage.

The receiving member is positioned such that a force may be applied to the support brace to pivot the brace in a vertical plane between an engaged position and a disengaged position. It is presently preferred to position the receiving member nearer the pivot end of the support brace than the locking means.

Importantly, and in contrast to prior art support braces, the present invention is integrally formed of a single unit of material and bent to configuration. The integral nature of the present invention offers significant advantages over the prior art braces which were comprised of at least three separate component pieces. As an initial matter, the manufacture of a single component, rather than three or more separate components, represents a cost-savings to the manufacturer. Additionally, less components makes it easier to store the support brace once manufactured. More importantly to the purchaser, since adjustable basketball goal systems are typically sold in an unassembled form, the single component nature of the present invention represents increased ease of assembly. Because the present support brace comprises a single component with a clearly defined top and base portion, the purchaser is less likely to install the support brace in a backwards or upside down manner, a problem that is common with the prior art, multiple component design.

Additionally, the angled sides are a significant feature of the novel support brace, giving the brace unique advantages over prior art support braces with parallel sides. One advantage is that the angled support brace is easily stackable. Multiple support braces are capable of being stacked one on top of another, with the base of one brace fitting within the trough of an adjacent brace. This is a significant advantage in terms of storage, both in space saved as well as ease of handling. Prior support braces do not offer this feature.

Another advantage related to the angled sides of the present invention is that the angled support brace more readily accommodates a post or bolt which has become bent through the normal course of usage. Prior art support braces, which comprise two parallel support arms with corresponding notches for engaging a post, do not accommodate a post or bolt once it has become bent. This is a result of the parallel nature of the two arms. In contrast, because the two sides of the present invention are angled with respect to each other, the present invention will more readily accommodate a post or bolt which is modestly bent.

A further advantage of the support brace of the present invention is that its unitary construction, with a base that extends substantially the entire length of the brace, imparts strength to the brace. The support brace is considerably less susceptible than the support brace of the '904 device to bending in shipping or by accidental jostling. Because the support brace is less susceptible to bending, its operability is enhanced when engaging the post in slidable engagement within the slot.

Accordingly, it is the general object of the present invention to provide an improved support brace for the adjustable support of a deformable parallelogrammatic structure which overcomes the aforementioned problems of the prior art support braces.

BRIEF DESCRIPTION OF THE DRAWINGS

In order that the manner in which the above-recited and other advantages and objects of the invention are obtained, a more particular description of the invention briefly described above will be rendered by reference to a specific embodiment illustrated in the appended drawings. Understanding that these drawings depict only a typical embodiment of the invention and is not to be considered limiting of its scope, the invention will be described and explained with additional specificity and detail through the use of the accompanying drawings in which.

DETAILED DESCRIPTION OF THE PREFERRED EMBODIMENTS

The present invention is directed to a support brace for the adjustable support of a basketball goal system having a deformable parallelogrammatic structure capable of deformation into a plurality of configurations.

Figure 1:
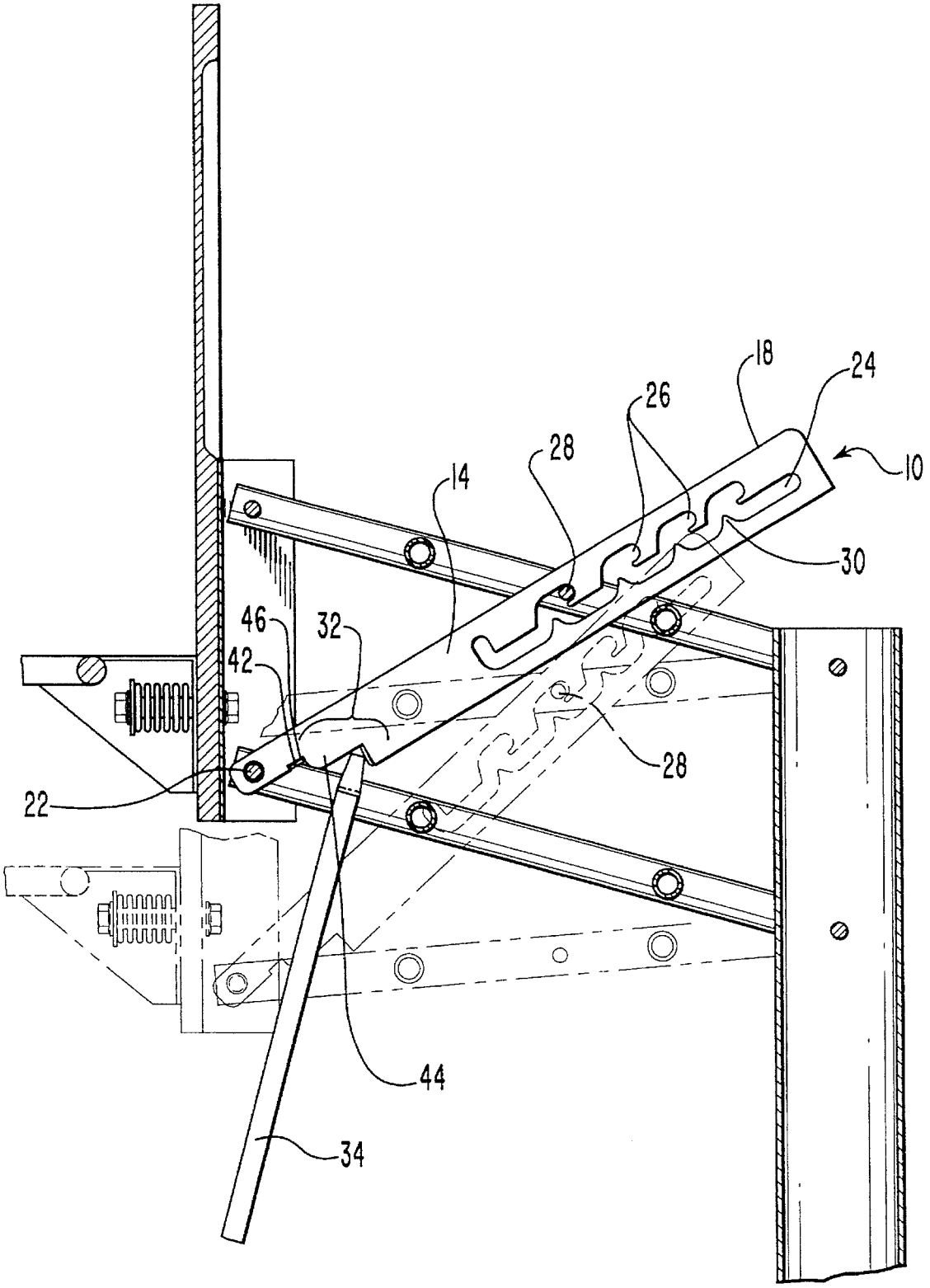
FIG. 1 is a cross-sectional schematic view of a deformable parallelogrammatic structure utilizing the present invention and disposed in one possible configuration. The phantom lines show the parallelogrammatic structure as it would appear in a lowered position.
Figure 2:
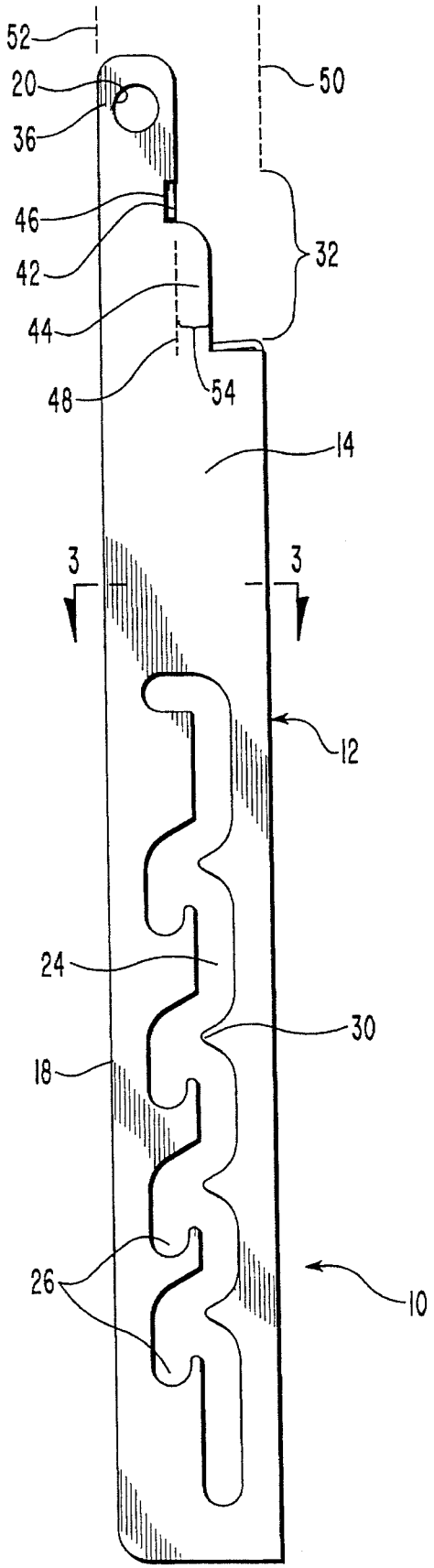
FIG. 2 is a side view of the present invention.
Figure 3:
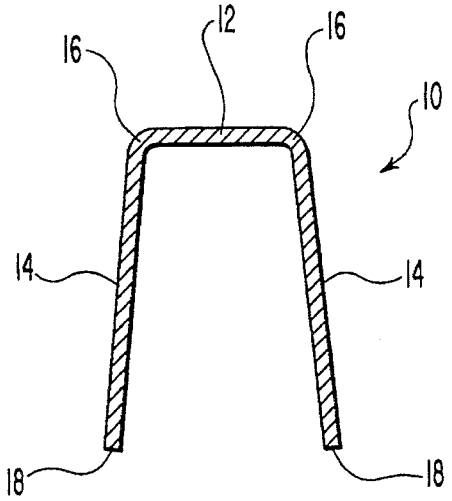
FIG. 3 is a cross-sectional view along line 3—3 depicting the angled nature of the sides of the support brace.

Reference is now made to the figures wherein like parts are referenced by like numerals throughout. In FIGS. 1–3, the angled support brace of the present invention is generally designated 10 and comprises a trough shaped member with an elongated base 12 and a pair of sides 14 angularly extending from the elongated base 12. Each side 14 has both a connected edge 16, which is connected to the elongated base 12, and a free edge 18. The sides 14 are angled with respect to each other such that the distance between the sides 14 is greater near the free edge 18 than it is nearer the base 12. This is most clearly depicted by FIG. 3. The angled nature of the sides 14 allows the support brace 10 to function as a stackable unit, wherein multiple support braces 10 are capable of being stacked one on top of another, with the base 12 of one brace fitting within the trough of an adjacent brace.

Each of the sides 14 has a pivot hole 20 at one of its ends. The pivot holes 20 enable the support brace 10 to be pivotally connected to the parallelogrammatic structure by means of a pivot pin 22. The support brace 10 may thus pivot about the pivot pin 22 in a vertical plane.

Each of the sides 14 of the support brace 10 further comprise a slot 24 extending substantially longitudinally along the side 14, wherein the slot 24 provides a series of notches 26 capable of engaging a post 28 connected to the deformable parallelogrammatic structure. The slot 24 and notches 26 therein on each side 14 correspond with the slot 24 and notches 26 of the other side 14. When the post 28 is engaged in one of the notches 26 along the slot 24, the deformable parallelogrammatic structure is secured into one of a plurality of configurations. This is best illustrated in FIG. 1.

Each slot 24 further comprises a plurality of sloped, guiding teeth 30 configured along each slot 24 such that for each notch 26 in the series of notches there corresponds one guiding tooth 30. The guiding teeth 30 provide a guiding means whereby the post 28 connected to the deformable parallelogrammatic structure is guided to one of the notches 26.

The support brace 10 of the present invention also comprises a receiving member 32 for receiving a tip of a force-applying implement 34 (such as a broom handle) and restraining the tip from inadvertent slippage from the support brace 10. The receiving member 32 is positioned such that a force may be applied to the support brace 10 to pivot the support brace in a vertical plane between an engaged and a disengaged position. In the present embodiment, the receiving member is positioned nearer the pivot end 36 of the support brace 10 than the longitudinal slot 24.

Figure 4:
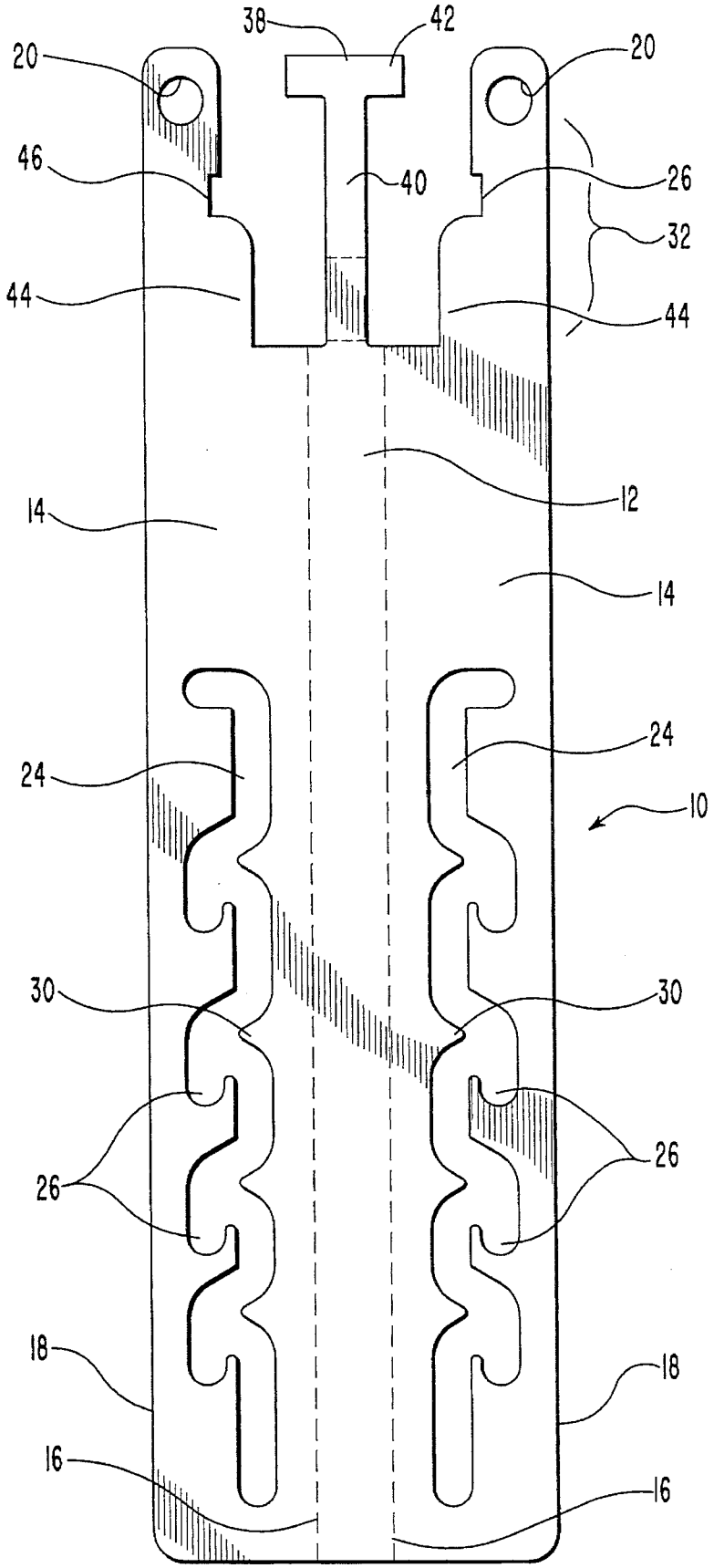
FIG. 4 is a plan view of the support brace in the pre-bent, flat with fold lines indicated by dashed lines.

The receiving member 32 comprises a "T"-shaped base member 38 with an elongated stem 40 and two side ears 42, and two sides 44 which are continuous with the angled sides of the support brace 10 (see FIG. 4). The elongated stem 40 is continuous with the elongated base 12 of the support brace 10. Each of the two sides 44 of the receiving member 32 contains a notch 46 which engages one of the side ears 42 of the "T"-shaped base member 38 when the support brace 10 is bent into its operable configuration.

The "T"-shaped base member 38 is positioned in a longitudinal plane 48 that is intermediate between the longitudinal plane 50 formed by the elongated base 12 of the support brace 10 and the longitudinal plane 52 formed by the two free edges 18 of the support brace sides 14. The two sides 44 of the receiving member 32 extend beyond the longitudinal plane 48 formed by the "T"-shaped base member 38 such that a pocket 54 is formed for receiving a tip of a force-applying implement 34. The pocket 54 thus formed prevents the inadvertent slippage of the force-applying implement from the support brace 10 when an upward force is applied.

Importantly, the novel support brace 10 of the present invention is integrally formed of a single unit of material and bent to configuration. This is best depicted by FIG. 4 which shows a plan view of the brace in the flat with fold lines in dashes, indicating how the piece is bent into its final configuration. This unitary construction imparts strength to the support brace 10 enhancing resistance to bending or other types of deformation.

From the foregoing, it will be appreciated that the present invention provides a novel support brace for the adjustable support of a basketball goal system having a deformable parallelogrammatic structure which avoids many of the problems inherent in prior art support braces. The present invention provides a support brace which is comprised of a single component, is stackable, is less likely to be assembled backwards or upside down, and is better suited for use with a bent post or bolt.

It should be appreciated that the present invention is capable of a variety of embodiments and various modifications which would be apparent from the above description to those skilled in the art. The described embodiments are to be considered in all respects as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by Letters Patent is:

1. A support brace for the adjustable support of a basketball goal system having a deformable parallelogrammatic structure capable of deformation into a plurality of configurations, said support brace being pivotally connected to the parallelogrammatic structure so that the brace can pivot in a vertical plane in response to the application and release of a force applying implement, said support brace comprising:

a trough shaped member with an elongated base and a pair of sides angularly extending from said base, each side having a connected edge and a free edge, said connected edge being connected to said base, said sides being angled with respect to each other such that the distance between the sides is greater near the free edge of each side than it is nearer the base, said trough shaped member comprises:

a locking means for securing said parallelogrammatic structure in one of a plurality of positions, said locking means having both engaged and disengaged positions; and a receiving member for receiving a tip of the force-applying implement and restraining the tip from inadvertent slippage from said support brace, said receiving member being positioned such that a force may be applied to said support brace to pivot said support brace in a vertical plane between an engaged position and a disengaged position said receiving member comprising a "T"-shaped base member with an elongated stem and a pair of side ears, the stem being continuous with the elongated base of the support brace, each side having a notch capable of engaging one of the side ears of the base member.

2. A support brace as set forth in claim 1, wherein the support brace is stackable such that multiple support braces are capable of being stacked one on top of another, with the base of one brace fitting within the trough of an adjacent brace.

3. A support brace as set forth in claim 1, wherein the support brace is integrally formed of a single unit of material.

4. A support brace as set forth in claim 1, wherein the receiving member is disposed nearer the pivot end of the support brace than the locking means.

5. A support brace as set forth in claim 1 wherein the support brace is integrally formed of a single unit of material and bent to configuration.

6. The support brace as set forth in claim 5, wherein the "T"-shaped base member is positioned in a longitudinal plane that is intermediate between the longitudinal plane formed by the elongated base of the support brace and the longitudinal plane formed by the free edges of the support brace sides, and the sides of the receiving member extend beyond the longitudinal plane formed by the "T"-shaped base member such that a pocket is formed for receiving a tip of the force-applying implement.

7. A support brace as set forth in claim 1, wherein the locking means for securing the deformable parallelogrammatic structure comprises a slot extending substantially longitudinally along each of the sides of the support brace, each said slot corresponding with the other slot, and each slot providing a series of notches capable of engaging a post connected to the deformable parallelogrammatic structure, such that when said post is engaged in one of said notches, the deformable parallelogrammatic structure is secured into one of a plurality of configurations.

8. A support brace as set forth in claim 7, wherein the locking means for securing the deformable parallelogrammatic structure further comprises a guiding means for guiding said support brace from a first position to a second position.

9. A support brace as set forth in claim 8, wherein the guiding means comprises a plurality of sloped, guiding teeth configured along each slot such that each notch corresponds to one guiding tooth.

10. A support brace for the adjustable support of a basketball goal system having a deformable parallelogrammatic structure capable of deformation into a plurality of configurations, said support brace being pivotally connected to the parallelogrammatic structure so that the brace can pivot in a vertical plane in response to the application and release of a force applying implement, said support brace comprising:

a trough shaped member with an elongated base and a pair of sides angularly extending from said base, each side having a connected edge and a free edge, said connected edge being connected to said base, said sides being angled with respect to each other such that the distance between the sides is greater near the free edge of each side than it is nearer the base, wherein said support brace is integrally formed of a single unit of material bent into configuration, and said support brace is stackable such that multiple support braces are capable of being stacked one on top of another, with the base of one brace fitting within the trough of an adjacent brace; said trough shaped member comprises:

a locking means for securing said parallelogrammatic structure in one of a plurality of positions, said locking means having both engaged and disengaged positions; and a receiving member for receiving a tip of the force-applying implement and restraining the tip from inadvertent slippage from said support brace, said receiving member being positioned such that a force may be applied to said support brace to pivot said support brace in a vertical plane between an engaged position and a disengaged position said receiving member comprising a "T"-shaped base member with an elongated stem and a pair of side ears, the stem being continuous with the elongated base of the support brace, each side having a notch capable of engaging one of the side ears of the base member.

11. A support brace as set forth in claim 10, wherein the receiving member is disposed nearer the pivot end of the support brace than the locking means.

12. The support brace as set forth in claim 10, wherein the "T"-shaped base member is positioned in a longitudinal plane that is intermediate between the longitudinal plane formed by the elongated base of the support brace and the longitudinal plane formed by the free edges of the support brace sides, and the sides of the receiving member extend beyond the longitudinal plane formed by the "T"-shaped base member such that a pocket is formed for receiving a tip of the force-applying implement.

13. A support brace as set forth in claim 10, wherein the locking means for securing the deformable parallelogrammatic structure comprises a slot extending substantially longitudinally along each of the sides of the support brace, each said slot corresponding with the other slot, and each slot providing a series of notches capable of engaging a post connected to the deformable parallelogrammatic structure, such that when said post is engaged in one of said notches, the deformable parallelogrammatic structure is secured into one of a plurality of configurations.

14. A support brace as set forth in claim 13, wherein the locking means for securing the deformable parallelogrammatic structure further comprises a guiding means for guiding said support brace from a first position to a second position.

15. A support brace as set forth in claim 14, wherein the guiding means comprises a plurality of sloped, guiding teeth configured along each slot such that each notch corresponds to one guiding tooth.

* * * * *